US005459697A

United States Patent [19]

Chin et al.

[11] Patent Number: 5,459,697

[45] Date of Patent: Oct. 17, 1995

[54] MWD SURFACE SIGNAL DETECTOR HAVING ENHANCED ACOUSTIC DETECTION MEANS

[75] Inventors: Wilson C. Chin; Kenneth H. Hamlin, both of Houston, Tex.

[73] Assignee: Halliburton Company, Dallas, Tex.

[21] Appl. No.: 292,090

[22] Filed: Aug. 17, 1994

[51] Int. Cl.[6] ..... H04H 9/00

[52] U.S. Cl. ..... 367/81; 367/83

[58] Field of Search ..... 367/81, 83, 84, 367/85, 912

[56] References Cited

U.S. PATENT DOCUMENTS

| | | | |
|---|---|---|---|
| 3,302,457 | 2/1967 | Mayes | 367/83 |
| 3,488,629 | 1/1970 | Claycomb | 367/83 |
| 3,716,830 | 2/1973 | Garcia | 367/83 |
| 3,784,822 | 1/1974 | Schuster | 250/260 |
| 3,949,354 | 4/1976 | Claycomb | 340/18 |
| 3,958,217 | 5/1976 | Spinnler | 340/18 |
| 3,964,556 | 6/1976 | Gearhart et al. | 175/45 |
| 4,047,027 | 9/1977 | Bateman et al. | 250/264 |
| 4,129,777 | 12/1978 | Wahl et al. | 250/264 |
| 4,152,545 | 5/1979 | Gilbreath et al. | 179/1.5 |
| 4,216,536 | 8/1980 | More | 367/83 |
| 4,401,134 | 8/1983 | Dailey | 137/624 |
| 4,511,843 | 4/1985 | Thoraval | 324/338 |
| 4,515,225 | 5/1985 | Dailey | 175/40 |
| 4,596,926 | 6/1986 | Coope | 250/265 |
| 4,661,933 | 4/1987 | Seeman et al. | 367/27 |
| 4,665,511 | 5/1987 | Rodney et al. | 367/35 |
| 4,715,022 | 12/1987 | Yeo | 367/83 |
| 4,733,232 | 3/1988 | Grosso | 367/82 |
| 4,734,892 | 3/1988 | Kotlyar | 367/83 |
| 4,736,204 | 4/1988 | Davison | 340/856 |
| 4,791,797 | 12/1988 | Paske et al. | 73/152 |
| 4,794,792 | 1/1989 | Flaum et al. | 73/152 |
| 4,839,870 | 6/1989 | Scherbatskoy | 367/83 |
| 4,864,129 | 9/1989 | Paske et al. | 250/269 |
| 5,006,845 | 4/1991 | Calcar et al. | 175/48 |
| 5,091,644 | 2/1992 | Minette | 250/254 |
| 5,130,950 | 7/1992 | Orban et al. | 367/34 |
| 5,159,577 | 10/1992 | Twist | 367/25 |
| 5,175,429 | 12/1992 | Hall, Jr. et al. | 250/262 |
| 5,214,251 | 5/1993 | Orban et al. | 181/102 |

FOREIGN PATENT DOCUMENTS

| | | |
|---|---|---|
| 2252623 | 8/1992 | United Kingdom . |

OTHER PUBLICATIONS

"Introduction to Petroleum Production," vol. 1, D. R. Skinner, Chapter 2, 3, 4.

IADC/SPE 14764; "Predicting Bottomhole Assembly Performance," by J. S. Williamson and A. Lubinski.

"Neutron Porosity Measurement While Drilling," by Michael L. Gartner, IEEE Transactions on Nuclear Science, vol. 35, No. 1, Feb. 1988.

*Primary Examiner*—J. Woodrow Eldred

*Attorney, Agent, or Firm*—Conley, Rose & Tayon

[57] ABSTRACT

The acoustic detector in a mud pulse telemetry system includes a one dimensional waveguide disposed between a pressure transducer and a conduit carrying drilling fluid to a drill string. The waveguide, which may include a flexible hydraulic hose, increases the amplitude of the acoustic mud pulse signal received at the transducer located at the termination end by a factor of two or more. In addition, the waveguide may be substantially filled with a fluid having a viscosity higher than the viscosity of the drilling fluid so as to provide a means to dampen high frequency noise, and thereby improve the signal-to-noise ratio at the pressure transducer.

14 Claims, 4 Drawing Sheets

MWD SURFACE SIGNAL DETECTOR HAVING ENHANCED ACOUSTIC DETECTION MEANS

BACKGROUND OF THE INVENTION

The present invention relates generally to the field of telemetry systems for transmitting information through a flowing stream of fluid. More particularly, the invention relates to the field of mud pulse telemetry where information detected at the bottom of a well bore is transmitted to the surface by means of pressure pulses created in the mud stream that is circulating through the drill string. Still more particularly, the invention relates to a surface detector for amplifying the signal transmitted by the pressure pulses during MWD or other drilling operations, and for providing an improved signal-to-noise ratio as compared to conventional mud pulse telemetry means.

Drilling oil and gas wells is carried out by means of a string of drill pipes connected together so as to form a drill string. Connected to the lower end of the drill string is a drill bit. The bit is rotated and drilling accomplished by either rotating the drill string, or by use of a downhole motor near the drill bit, or by both methods. Drilling fluid, termed mud, is pumped down through the drill string at high pressures and volumes (such as 3000 p.s.i. at flow rates of up to 1400 gallons per minute) to emerge through nozzles or jets in the drill bit. The mud then travels back up the hole via the annulus formed between the exterior of the drill string and the wall of the borehole. On the surface, the drilling mud is cleaned and then recirculated. The drilling mud is used to cool the drill bit, to carry chippings from the base of the bore to the surface, and to balance the hydrostatic pressure in the rock formations.

When oil wells or other boreholes are being drilled, it is frequently necessary or desirable to determine the direction and inclination of the drill bit and downhole motor so that the assembly can be steered in the correct direction. Additionally, information may be required concerning the nature of the strata being drilled, such as the formation's resistivity, porosity, density and its measure of gamma radiation. It is also frequently desirable to know other down hole parameters, such as the temperature and the pressure at the base of the borehole, as examples. Once these data are gathered at the bottom of the bore hole, it is typically transmitted to the surface for use and analysis by the driller.

One prior art method of obtaining at the surface the data taken at the bottom of the borehole is to withdraw the drill string from the hole, and to lower the appropriate instrumentation down the hole by means of a wire cable. Using such "wireline" apparatus, the relevant data may be transmitted to the surface via communication wires or cables that are lowered with the instrumentation. Alternatively, the instrumentation may include an electronic memory such that the relevant information may be encoded in the memory to be read when the instrumentation is subsequently raised to the surface. Among the disadvantages of these wireline methods are the considerable time, effort and expense involved in withdrawing and replacing the drill string, which may be, for example, many thousands of feet in length. Furthermore, updated information on the drilling parameters is not available while drilling is in progress by wireline techniques.

A much-favored alternative is to employ sensors or transducers positioned at the lower end of the drill string which, while drilling is in progress, continuously or intermittently monitor predetermined drilling parameters and formation data and transmit the information to a surface detector by some form of telemetry. Such techniques are termed "measurement while drilling" or MWD. MWD results in a major savings in drilling time and cost compared to the wireline methods described above.

Typically, the down hole sensors employed in MWD applications are positioned in a cylindrical drill collar that is positioned close to the drill bit. The MWD system then employs a system of telemetry in which the data acquired by the sensors is transmitted to a receiver located on the surface. There are a number of telemetry systems in the prior art which seek to transmit information regarding downhole parameters up to the surface without requiring the use of a wireline tool. Of these, the mud pulse system is one of the most widely used telemetry systems for MWD applications.

The mud pulse system of telemetry creates acoustic signals in the drilling fluid that is circulated under pressure through the drill string during drilling operations. The information that is acquired by the downhole sensors is transmitted by suitably timing the formation of pressure pulses in the mud stream. The information is received and decoded by a pressure transducer and computer at the surface.

In a mud pressure pulse system, the drilling mud pressure in the drill string is modulated by means of a valve and control mechanism, generally termed a pulser or mud pulser. The pulser is usually mounted in a specially adapted drill collar positioned above the drill bit. The generated pressure pulse travels up the mud column inside the drill string at the velocity of sound in the mud. Depending on the type of drilling fluid used, the velocity may vary between approximately 3000 and 5000 feet per second. The rate of transmission of data, however, is relatively slow due to pulse spreading, modulation rate limitations, and other disruptive forces, such as the ambient noise in the drill string. A typical pulse rate is on the order of a pulse per second. Some present day systems operate at higher frequencies, for example at 8–12 pulses per second. Representative examples of mud pulse telemetry systems may be found in U.S. Pat. Nos. 3,949,354, 3,958,217, 4,216,536, 4,401,134, and 4,515,225.

Mud pressure pulses can be generated by opening and closing a valve near the bottom of the drill string so as to momentarily restrict the mud flow. In a number of known MWD tools, a "negative" pressure pulse is created in the fluid by temporarily opening a valve in the drill collar so that some of the drilling fluid will bypass the bit, the open valve allowing direct communication between the high pressure fluid inside the drill string and the fluid at lower pressure returning to the surface via the exterior of the string.

Alternatively, a "positive" pressure pulse can be created by temporarily restricting the downwardly flow of drilling fluid by partially blocking the fluid path in the drillstring. One type of positive pulser is the mud siren. The mud siren includes a rotating member which includes apertures which periodically restrict the mud flow in the drill string. This produces a train of pulses which are phase modulated to transmit data.

Whatever type of pulse system is employed, detection of the pulses at the surface is sometimes difficult due to attenuation of the signal and the presence of noise generated by the mud pumps, the downhole mud motor and elsewhere in the drilling system. Typically, a pressure transducer is mounted directly on the line or pipe that is used to supply the drilling fluid to the drill string. An access port or tapping is formed in the pipe, and the transducer is threaded into the port. With some types of transducers, a portion of the device extends into the stream of flowing mud where it is subject to wear and damage as a result of the abrasive nature and high velocity of the drilling fluid. In any case, the transducer detects variations in the drilling mud pressure at the surface and generates electrical signals responsive to these pressure variations.

Unfortunately, the pressure pulses at the surface may frequently be weak and therefore difficult to detect or to distinguish from background noise. Because of the substantial noise created by the mud pumps and other system components, the signal-to-noise ratio is often very low. Such low signal-to-noise ratios may be increased by increasing the strength of the downhole signal that is generated by the mud pulser. This may be accomplished, for example, by altering the distance between various components which make up the valves and flow restricters in the pulser. While these alterations can increase signal strength, they are often undesirable since the likelihood of erosion and jamming of the valve components increases due to debris in the mud stream. Another means to improve signal detection is to employ special signal conditioning techniques in order to extract the desired signal from the background noise. This alternative, however, necessitates the use of sophisticated and expensive electronic signal processing equipment. Even using such equipment, however, detection can still be unreliable or impossible in certain circumstances.

Thus, due to the drilling industry's ever increasing reliance on MWD techniques, and due to the present inadequacies with respect to detecting a mud pulse signals, there remains a need in the art for a detector that is capable of enhancing the amplitude of the acoustic signal seen by the pressure transducer. Preferably, such a detector would be relatively inexpensive and simple to construct. Due to the substantial number of existing detection systems now in use, it would be advantageous if the detector could be constructed, at least in part, from the components presently in use. Preferably, the detector would permit the transducer to be positioned outside the mud flow path such that it would not be susceptible to abrasive damage from the flowing drilling fluid. It would be ideal if the detector would also provide for an increased signal-to-noise ratio in addition to the increase in signal amplitude.

SUMMARY OF THE INVENTION

Accordingly, the present invention provides an acoustic signal detector for receiving mud pulse telemetry wherein the detector provides for at least a doubling of the mud pulse signal amplitude. Additionally, the invention may be employed so as to provide an improved signal-to-noise ratio. The invention is conveniently transported and installed, and may be constructed of readily available components.

The invention includes a pressure transducer for converting pressures sensed by the transducer into corresponding electrical signals. The invention further includes a one dimensional waveguide disposed between the pressure transducer and a pressure port in the conduit carrying the drilling fluid to a drill string. The waveguide, which may include a flexible hydraulic hose, increases the amplitude of the acoustic mud pulse signal received at the transducer acoustic termination end by a factor of two or more as compared to the incident amplitude of the signal in the conduit, a fact well known to practitioners in acoustics.

In addition, the detector may include a noise-dampening fluid contained in the waveguide. The dampening fluid is characterized by a high viscosity that preferentially damps out noise that is higher in frequency than the signal frequency. A membrane impermeable to both the drilling fluid and the viscous dampening fluid may be included in the waveguide to prevent the fluids from mixing. The presence of the high viscosity fluid provides a means to dampen noise in the system where the noise has a higher frequency than the frequency of the desired mud pulse signal. This dampening of the high frequency noise thereby improves the signal-to-noise ratio at the pressure transducer and may eliminate the necessity for the use of more costly and elaborate signal detection and conditioning equipment.

The invention further may include a multi-segmented waveguide, where the inside diameter of a second segment of the waveguide is less than the inside diameter of a first waveguide. The first and second waveguide segments may comprise separate lengths of flexible hose that are interconnected by a reducing coupling or connector. When such a multisegmented waveguide is disposed between a pressure transducer and the conduit carrying the drilling fluid, the amplitude of the acoustic signal detected at the transducer will be increased by a factor greater than two. Where the diameters are chosen such that the cross sectional area of the second waveguide segment is one half the cross-sectional area of the first segment, a quadrupling in amplitude will be seen by the pressure transducer at the waveguide termination end. Again, a relatively high viscosity fluid may be included in the waveguide to dampen high frequency noise and provide for an improved signal-to-noise ratio.

The invention may alternatively include a differential pressure transducer having two pressure input ports, and a T-connector that has a first arm connected to the conduit carrying the drilling fluid. A waveguide is connected between one of the two remaining arms of the T-connector and one input port on the transducer. A conduit is interconnected between the remaining arm of the T-connector and the remaining input port of the transducer. This embodiment provides two acoustic paths for the mud pulses to propagate to the transducer and likewise achieves a doubling of the mud pulse signal amplitude. Appropriately sized lengths of flexible hose may serve as the waveguide or conduit, or both. The waveguide may include a segment having a reduced cross-sectional area so as to increase the amplitude of the signal by more than two, or may include a segment that contains a relatively high viscosity fluid to increase the signal-to-noise ratio.

In addition, the invention includes a method for detecting an acoustic mud pulse signal in drilling fluid. The method includes positioning a waveguide between a pressure transducer and an access port in a line supplying the drilling fluid so as to increase the amplitude of the signal at the transducer by a factor of at least two, as compared with conventional methods.

Thus, the present invention comprises a combination of features and advantages which enable it to substantially advance the mud pulse telemetry art by providing a method and apparatus to substantially increase the amplitude of acoustic signals in drilling mud, and to improve the signal-to-noise ratio. The invention provides a simple method and mechanical apparatus that will reliably enhance signal detection. These and various other characteristics and advantages of the present invention will be readily apparent to those skilled in the art upon reading the following detailed description and referring to the accompanying drawings.

BRIEF DESCRIPTION OF THE DRAWINGS

For a detailed description of the preferred embodiment of the invention, reference will be made now to the accompanying drawings, wherein.

DETAILED DESCRIPTION OF THE PREFERRED EMBODIMENTS

Figure 1:
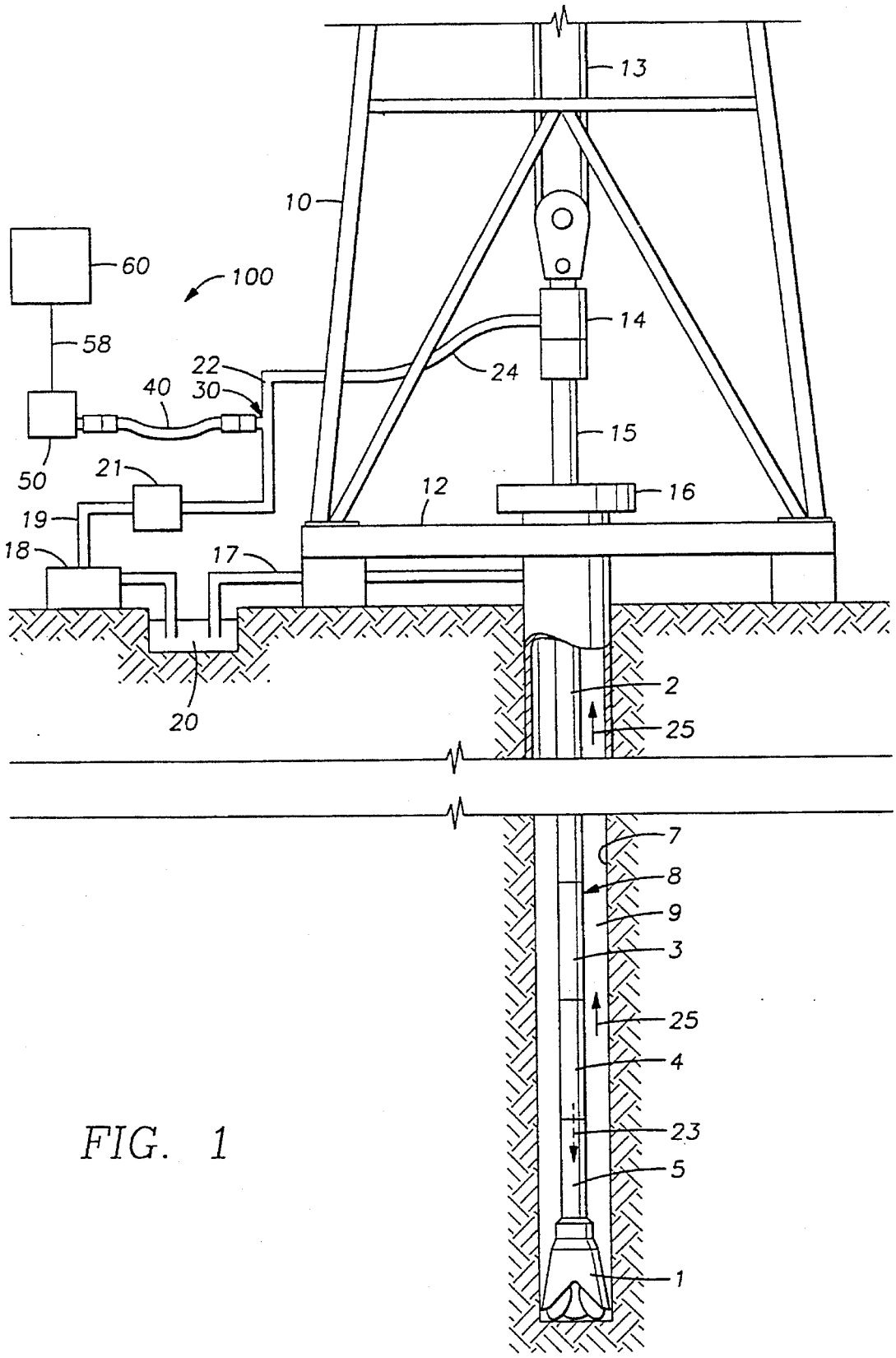
FIG. 1 is a schematic view, partly in cross section, of an oil well drilling and mud pulse telemetry system employing the signal detection apparatus of the present invention.

FIG. 1 depicts a well drilling system configured for MWD operation and having a mud pulse telemetry system for orienting and monitoring the drilling progress of a drill bit 1 and mud motor 5. A drilling derrick 10 is shown and includes a derrick floor 12, draw works 13, swivel 14, kelly joint 15, rotary table 16 and drill string 8. Derrick 10 is connected to and supplies tension and reaction torque for drill string 8. Drill string 8 includes the mud motor 5, drill pipe 2, standard drill collars 3 (only one of which is shown), a mud pulser subassembly 4, and drill bit 1. A conventional mud pump 18 pumps mud out of a mud pit 20 through conduit 19 to the desurger 21. From desurger 21, the mud is pumped through stand pipe 22 and the rest of mud supply line 24 into the interior of the drill string 8 through swivel 14. As well understood by those skilled in the art, the interior of the drill string 8 is generally tubular, allowing the mud to flow down through the drill string 8 as represented by arrow 23, exiting through jets (not shown) formed in drill bit 1. As represented by arrows 25, after exiting the drill string 8, the mud is recirculated back upward along the annulus 9 that is formed between the drill string 8 and the wall of the borehole 7, where the mud returns to the mud pit 20 through pipe 17.

In addition, although not shown in FIG. 1, the drill string 8 includes a number of conventional sensing and detection devices for sensing and measuring a variety of parameters useful in the drilling process. A variety of electronic components are also included in the drill string 8 for processing the data sensed by the sensors and sending the appropriate signal to the pulser unit 4. Upon receipt of those signals, pulser unit 4 transmits an acoustic signal to the surface through the downwardly flowing mud 23 in the drill pipe 2.

The acoustic signal generated by pulser 4 is received and detected by surface signal detector 100. Detector 100 generally includes waveguide 40 and pressure transducer 50. A pressure port 30 is included in stand pipe 22. Waveguide 40 interconnects pressure port 30 and transducer 50 as explained in more detail with reference to FIGS. 2 and 3 below. Transducer 50 senses the pressure pulses that are generated in the drilling mud by mud pulser 4. These pulses travel to the top of the borehole and are transmitted through mud supply line 24, stand pipe 22 and waveguide 40 to transducer 50. Transducer 50 converts the pulses to electrical signals and transmits the signals via electrical conductor 58 to signal processing and recording apparatus 60.

Figure 2:
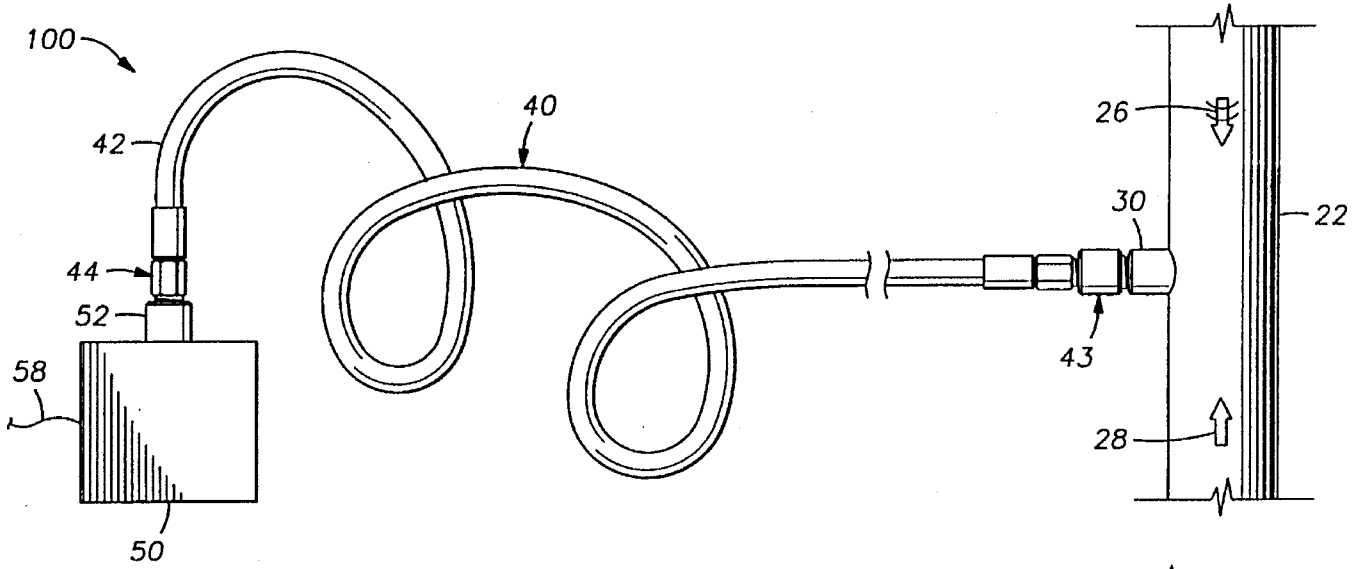
FIG. 2 is an enlarged schematic view, partly in cross section, of the detection apparatus shown in FIG. 1.

Referring now to FIG. 2, a portion of stand pipe 22 is shown carrying flowing drilling mud, represented by arrow 28. As previously described, stand pipe 22 also conducts the pressure pulses generated by the downhole mud pulser 4, such pressure pulses being represented by arrow 26. Mud flow 28 and pressure pulses 26 pass pressure port 30 travelling in opposite directions.

Figure 3:
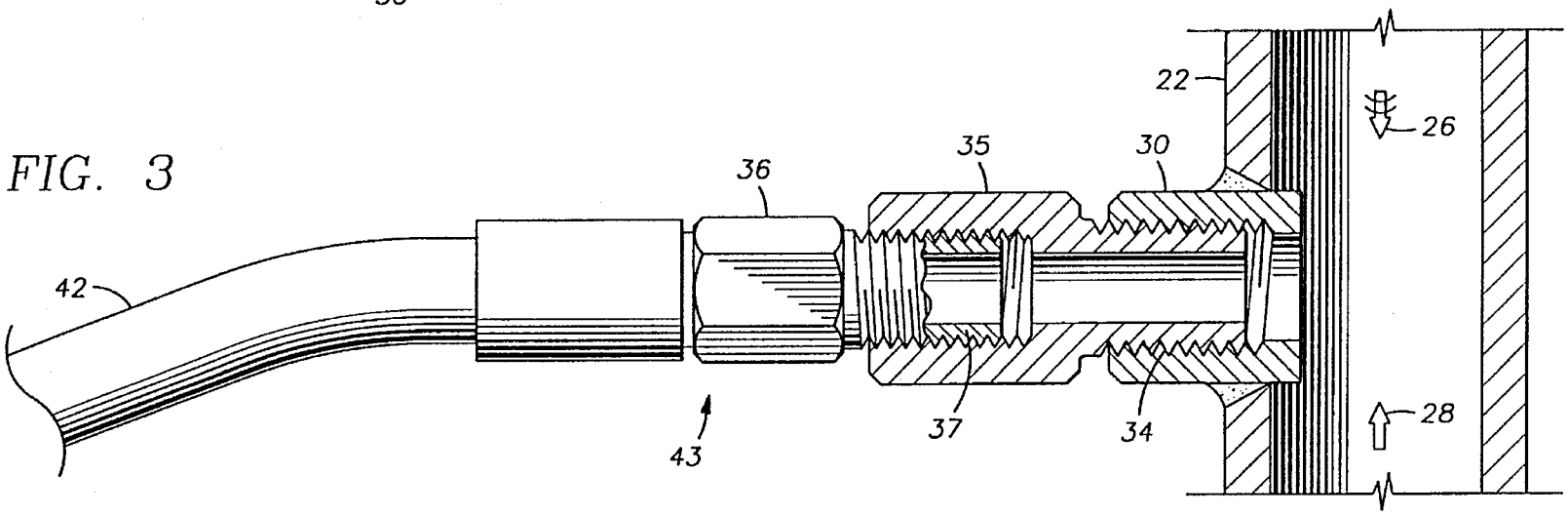
FIG. 3 is an enlarged view of a portion of the detection apparatus shown in FIG. 2.

Referring momentarily to FIG. 3, pressure port 30 comprises a tapped port 30 formed in standpipe 22. Such ports are well known to those skilled in the art and generally include an extending collar 32 having an internally threaded portion 34. Port 30 may be positioned at any location in the mud supply line 24 or conduit 19 which interconnects mud pump 18 and desurger 21; however, locating port 30 in stand pipe 22 has been found successful in practicing the present invention as well as convenient, as such ports are typically already existing in such locations for use with conventional pressure detection apparatus.

Referring again to FIG. 2, in the preferred embodiment, waveguide 40 is a flexible hose 42 capable of transporting high pressure drilling fluid. Hose 42 includes ends 43 and 44 for connection to pressure port 30 and transducer 50, respectively. Hose 42 serves as a one dimensional waveguide for transmitting the pressure pulses 26 in stand pipe 22 to the pressure transducer 50 via the drilling mud which fills the hose 42.

It is well known in the field of acoustics that the amplitude of a pressure wave travelling in a one dimensional waveguide such as hose 42 will double at the solid end termination of the waveguide. Transducer 50, described in more detail below, serves as such a solid end termination for waveguide 40. Accordingly, the amplitude of the acoustic signal 26 generated by mud pulser 4 (FIG. 1) transmitted through drill string 8 and mud supply line 24 will be doubled at transducer 50. In other words, the pressure measured by transducer 50 at the end 44 of hose 42 will be twice as great than if the pressure were measured in the conventional way by measuring with a transducer positioned on the standpipe 22 at pressure port 30.

In order to achieve this doubling in signal amplitude at end 44, it is necessary that hose 42 have a certain minimum length so that the incident pressure wave 26 can "recognize" the mud filled hose 42 as a one dimensional waveguide 40, rather than as an ineffective lumped mass. If hose 42 is not of a length sufficient for it to function as a waveguide, the doubling in signal amplitude will not occur. A wave encountering a lumped mass will not exhibit the doubling effect. A hose 42 that is less than the minimum length required for it to function as a waveguide tends to force the mud filled hose 42 to appear to the wave 26 as a lumped mass. Thus, as used in this application, the term "waveguide" means a conduit having a length sufficient to achieving the doubling in signal amplitude.

The exact minimum length of hose 42 necessary for hose 42 to function as a waveguide 40 will vary depending on the wavelength of the signal being detected. The wavelength, in turn, is dependent on the density, bulk modulus and other characteristics of drilling mud or fluid in which the signal 26 is propagating. More specifically, as is well known, the wavelength of the acoustic signal 26 is equal to the velocity that the wave travels in the fluid divided by the frequency of the signal being generated by mud pulser 4. The velocity of pressure pulses 26 in drilling fluids used today ranges from 3000 to 5000 feet per second. Using such drilling muds, it is presently believed that a hose 42 having a length equal to one quarter wavelength or greater will achieve the doubling in wave amplitude and thus function as a waveguide 40. A hose 35 feet long has been shown to be insufficient to cause the doubling where the frequency of the signal was 20 hertz and where the drilling mud allowed the signal to propagate at a velocity of 4000 feet per second. Using the same drilling mud and signal frequency, a hose having a length of 100 feet was found to yield the desired pressure doubling and thus functioned as a waveguide 40.

In the preferred embodiment, hose 42 has an internal diameter of approximately one quarter inch, although larger or smaller diameters may be successfully employed. A one hundred foot hose 42 having this diameter has proved to be convenient to transport and install. The length of hose 42 disposed between pressure port 30 and transducer 50 may, for convenience, be coiled to the minimum radius specified by the hose manufacturer. Alternatively, the hose 42 may be extended so as to provide a relatively straight run of hose. It is important, however, to prevent the hose 42 from becoming kinked, as such kinks may be seen by the incident pressure pulses 26 as a reduction in hose length, thus, rendering hose 42 ineffective as a waveguide. For that reason, as well as for increased strength and safety, it is preferred that hose 42 include one or more layers of high strength wire braid. Hose 42 must also be capable of transporting abrasive and corrosive drilling mud under high pressure. A hose found to be particularly desirable in this application as waveguide 40 is hydraulic hose manufactured by Aeroquip Corporation of Jackson, Mich. and is identified by part No. 2807-3.

While a flexible hose 42 is preferred for waveguide 40, a rigid conduit may alternatively be employed. However, it has been found that a flexible hose is preferred for ease of handling, due to the relatively long length that is required for waveguide 40. High pressure hydraulic hose is also inexpensive, light weight and widely available. The hose 42 has the additional advantages that it is mechanically simple and reliable, requiring that only two connections be made at ends 43 and 44. By contrast, a string of rigid metal conduit, for example, would require the connection of a large number of pipe fittings.

Referring again to FIG. 3, hose 42 is connected at end 43 to pressure port 30 by means of adapter 35 and end fitting 36 which is attached to and forms the termination (wave entry point) of hose 42. As shown, port 30 includes threaded surface 34 which threadedly receives a threaded extension of adapter 35. In a like manner, extension or stem 37 of end fitting 36 threadedly engages adapter 35. So connected, the interior passageway of hose 42 is thus in fluid communication with the mud stand pipe 22, by which it is meant that mud from stand pipe 22 can pass into and fill hose 42. In this manner, hose 42 may be thought of as a branch line of mud supply line 24, although hose 42 will be filled with static or relatively stagnant drilling fluid as compared to the flow of drilling fluid in mud supply line 24. As well known to those skilled in the art, hose 42 may be interconnected with port 30 using a myriad of fittings and adapters other than those described and shown in FIG. 3 so as to achieve the same fluid transporting arrangement.

A conventional strain gauge pressure transducer 50 is connected to the end 44 of waveguide 40 and functions as a pressure-doubling termination of waveguide 40. Preferably, transducer 50 is a piezoelectric type transducer. A transducer found to be particularly suited for the present invention is model No. HS112A21 manufactured by PCT Piezotronics, Inc. of Depew, N.Y. Transducer 50 includes an input port 52 to which end 44 of waveguide 40 is connected. Waveguide 40 is filled with drilling mud so as to provide a means for transmitting the acoustic signal 26 from the stand pipe 22 to pressure transducer 50. To ensure good wave transmission, all air should be bled from waveguide 40 during installation.

In addition to doubling the amplitude of the signal seen by transducer 50, waveguide 40 also physically isolates the transducer 50 from the turbulent mud flow noise and vibration in the standpipe 22. Locating transducer 50 away from this source of additional noise increases the signal to noise ratio that may be obtained. In addition, because the transducer 50 lies in a region of stagnant mud flow in waveguide 40, transducer 50 is not subject to erosion from the flow of abrasive mud.

Figure 7:
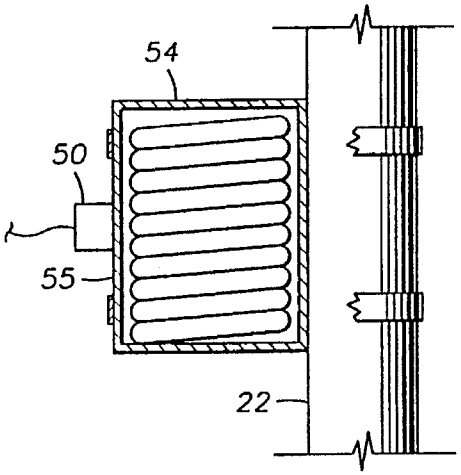
FIG. 7 is a schematic view, partly in cross section, of an enclosure for housing the detection apparatus of FIGS. 2–6.

Referring briefly to FIG. 7, detector 100 may further include a protective drum or other enclosure 54 for housing hose 42. Enclosure 54 preferably is made of sheet steel and may be supported from standpipe 22 or a structural member of derrick 10. As shown, transducer 50 may be supported on an outside wall 55 of enclosure 54 for convenient access. Alternatively, transducer 50 may also be located within enclosure 54. Should hose 42 or a hose connector fail, enclosure 54 shields personnel from possible harm caused by flailing hose sections or by the spray of pressurized drilling fluid.

Figure 4:
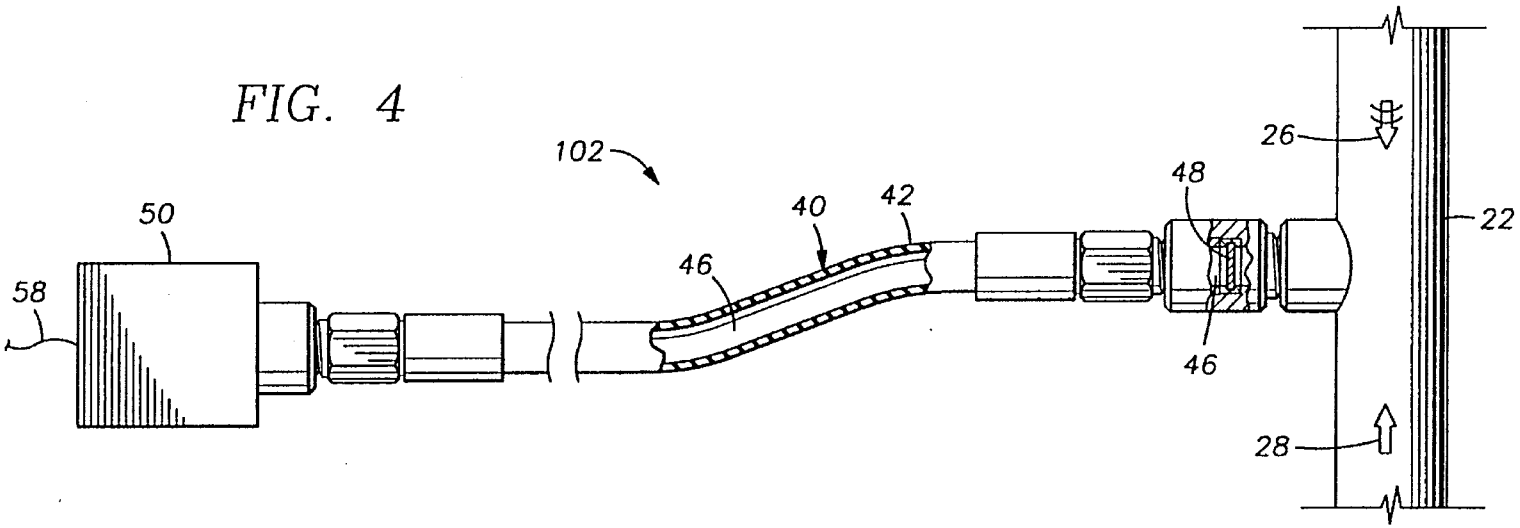
FIG. 4 is an enlarged schematic view, partly in cross section, of an alternative embodiment of the detection apparatus of the present invention.
Figure 5:
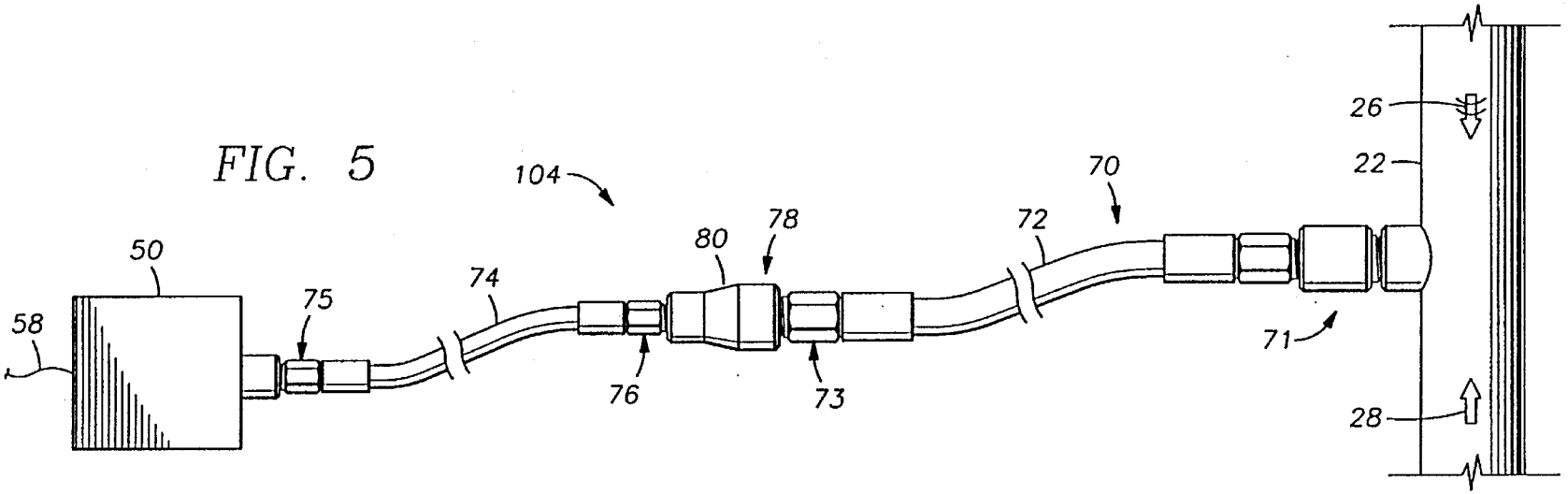
FIG. 5 is an enlarged schematic view, partly in cross section, of another alternative embodiment of the detection apparatus of the present invention.
Figure 6:
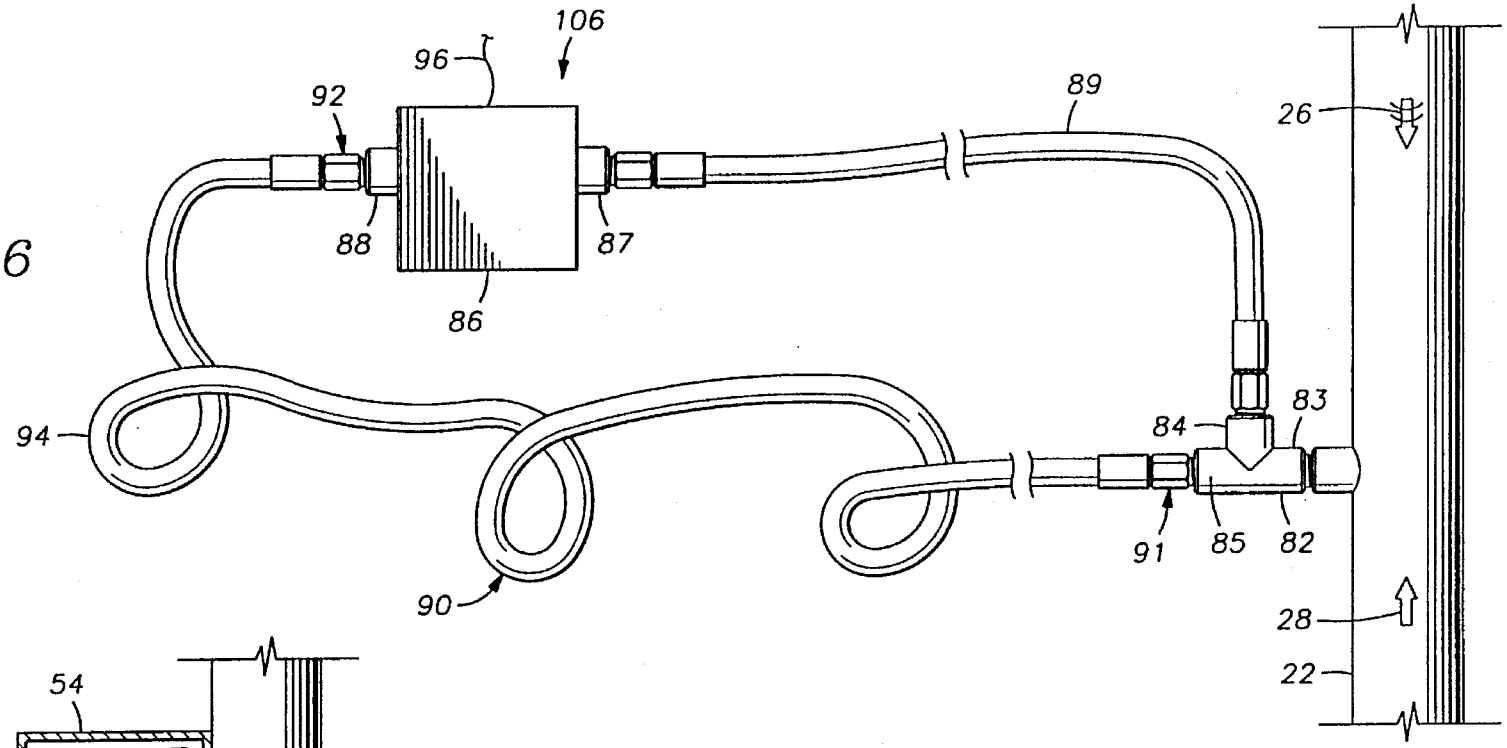
FIG. 6 is an enlarged schematic view, partly in cross section, of another alternative embodiment of the detection apparatus of the present invention.

FIGS. 4–6 show a number of other alternative embodiments of the present invention. These alternative embodiments employ many elements that are identical to those previously shown and described with reference to FIGS. 1–3. Accordingly, where like elements are shown and described in FIGS. 4–6, reference numbers identical to those previously employed may be used.

From reading the description above, it will be understood by those skilled in the art that the amplitude of the noise appearing at transducer 50 will likewise be doubled in a like manner and for the same reason that the desired pressure signal is doubled. In many instances, this is of no concern, as known signal processing and enhancing equipment is capable of distinguishing and separating the signals. In other applications, it may be desirable to cause the pressure signal 26 to double, but to dampen the noise so as to yield an improved signal-to-noise ratio at transducer 50. This may be especially desirable in situations where the pressure signal strength is particularly low.

An alternative embodiment of the present invention is shown in FIG. 4 and includes a detector 102 which provides for the above-described doubling of pressure signal amplitude, and which dampens the noise so as to provide an improved signal-to-noise ratio. Detector 102 generally includes hose 42 and pressure transducer 50 both identical to those previously described with reference to FIG. 2. Once again, hose 42 is of a length sufficient to function as a waveguide 40 and to yield a doubling in signal amplitude at pressure transducer 50. In this embodiment, detector 102 further includes a noise-dampening fluid 46 within hose 42 and a membrane 48 disposed inside hose 42 adjacent to waveguide end 43. Membrane 48 retains fluid 46 within hose 42 and prevents it from becoming mixed with drilling mud 28 flowing in stand pipe 22.

Fluid 46 is preferably a fluid having a viscosity greater than the viscosity of the drilling mud 28. A particularly desirable fluid 46 for this application is glycerin which has a viscosity of 300–400 centipoise at room temperature. Drilling fluids typically have viscosities within the range of approximately 50–200 centipoise. As a comparison, water at 20° C. has a viscosity of only 1 centipoise.

Membrane 48 is a relatively thin diaphragm that is impermeable to both mud 28 and to noise-dampening fluid 46. Membrane 48 is also inert with respect to drilling mud 28 which may be an oil based material. One material suitable for membrane 48 is a Viton® rubber made by E.I. DuPont DeNemours Co., Inc. Membrane 48 is disposed across the fluid passageway of hose 42 so as to form a fluid barrier to prevent fluid 46 from escaping into stand pipe 22. Because the wavelengths of the pressure signals generated by mud pulser 4 is relatively long, the pressure wave 26 passes through membrane 48 and along waveguide 40 unimpeded. Membrane 48 is retained in hose 42 by means of clamping the membrane into a suitable hydraulic fitting or by bonding the membrane within the hose.

In many MWD applications, the frequency of the pressure signal 26 is much less than the frequency of the noise generated elsewhere in the system. For example, a common frequency for a mud pulse signal generated by mud pulser 4 is 1 hertz or less. At the same time, it is common for mud pumps 18 to generate noise having a frequency in the range of 8 hertz. It is of course well known that higher frequency signals will damp out faster than lower frequency signals. It is also well known that the higher the viscosity of the fluid in which an acoustic signal is travelling, the faster the rate at which the signal will be dampened. Accordingly, by providing noise-damping fluid 46 in waveguide 40 instead of drilling mud 28, the higher frequency mud pump noise will dampen faster in waveguide 40 than the pressure pulses 26, such that the signal received by acoustic pressure transducer 50 has a higher signal-to-noise ratio than would otherwise be achieved. The higher signal-to-noise ratio may in some cases make more expensive and elaborate signal processing equipment unnecessary.

Figure 8:
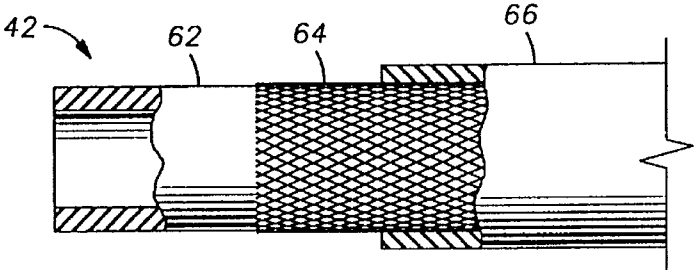
FIG. 8 is an enlarged cutaway view of a portion of the detection apparatus of FIGS. 2–6.

The dampening of high frequency noise may also be achieved by employing a hose 42 having resilient walls or a resilient inner wall surface. Such a hose is shown in FIG. 8. As shown, hose 42 includes an inner core or tube portion 62 that is covered by a layer of reinforcement 64 and an outer protective layer 66. Core portion 62 is formed of a resilient rubber such as Viton® rubber. Reinforcement 64 may be a layer of braided steel wire or mesh. To provide greater resiliency to hose 42, reinforcement layer 64 may be made of polyester fiber, for example. The yielding or resilient surface of core 62 of hose 42 absorbs energy imparted to the walls of hose 42 by the noise and by the desired acoustic signal; however, like the viscous fluid 46 described above, the resiliency of the core 62 of hose 42 serves to dampen the high frequency noise faster than the desired mud pulse signal. Dampening of the high frequency noise may also be accomplished employing a hose 42 having a length longer than the length necessary for hose 42 to function as a waveguide 40. Whatever resiliency the hose 42 exhibits, the additional length of hose 42 dampens the high frequency noise to a larger extent than the desired mud pulse signal.

Referring now to FIG. 5, another alternative embodiment of the present invention is shown. Rather than a doubling of signal amplitude of pressure signal 26, an even greater increase in signal amplitude can be achieved by means of detector 104 as shown in FIG. 5. Detector 104 generally includes a waveguide 70 and transducer 50. Waveguide 70 includes two hose segments or sections 72 and 74 joined together at junction 78. Hoses 72 and 74 are flexible hoses capable of carrying high pressure drilling fluid and may be constructed of the same materials and be of the same design as hose 42 previously described with respect to FIG. 2. Importantly, the inside diameter of hose 74 is selected to be less than the inside diameter of hose 72. For example, hose 72 may have a one-half inch inside diameter and hose 74 a quarter inch inside diameter. Smaller or larger sizes may be used; however, smaller hoses may be more susceptible to becoming kinked. As described previously, kinks in the hoses 72, 74 may be perceived by the pressure signal 26 as a solid termination and thereby impede the transmission of the pressure signal through the waveguide 70. End 71 of hose 72 is connected to port 30 in stand pipe 22, and end 75 of hose 74 is connected to pressure transducer 50, such connections being similar to the hose connections previously described with reference to FIG. 2. In the preferred embodiment for waveguide 70, junction 78 comprises a metallic reducer coupling 80 sized to receive and secure ends 73 and 76 of hoses 72 and 74 respectively.

Using hoses 72, 74 with inside diameters sized such that the area of the waveguide 70 is reduced by half at junction 78 will yield a quadrupling in the amplitude of the pressure wave 26 at transducer 50 as compared to the same wave if measured at pressure port 30 in stand pipe 22. Providing reductions in the waveguide area at junction 78 of other proportions will yield different increases in measured signal amplitude at transducer 50. For example, if the ratio of inside cross sectional areas of hoses 72 to 74 at junction 78 is greater than two to one, the pressure signal's amplitude will be more than quadrupled at transducer 50. In all cases, however, to achieve the increased amplitude at transducer 50 using a reduction in the cross-sectional area inside the waveguide 70, it is important that the length of waveguide 70 having the reduced cross-sectional area, such as hose 74 in the embodiment of FIG. 5, have a length equal to or greater than one quarter of the wavelength of the pressure wave 26 that is generated by mud pulser 4.

Referring now to FIG. 6, another alternative embodiment of the present invention is shown. As shown, signal detector 106 generally includes a T-connector 82, differential pressure transducer 86, conduit 89 and wave guide 90. T-connector 82, in concert with waveguide 90 and conduit 89, directs the acoustic energy of pressure wave 26 into two separate paths leading to differential pressure transducer 86.

T-connector 82 is a rigid metallic fitting having arms 83, 84 and 85, each having a fluid passageway which intersects with the others within connector 82. A suitable T-connector 82 is part no. 2092-8-8S manufactured by Aeroquip Corporation. A conventional connector, such as a pipe nipple (not shown), interconnects arm 83 of connector 82 to pressure port 30 on stand pipe 22.

Differential pressure transducer 86 is interconnected with T-connector 82 by conduit 89 and waveguide 90. Differential transducer 86 includes two pressure input ports 87, 88. As known in the art, differential pressure transducer 86 compares the pressures appearing at ports 87, 88 and generates an electrical signal corresponding to the difference in those pressures. Waveguide 90 is connected between port 88 of transducer 86 and arm 85 of T-connector 82. Conduit 89 is connected between pressure port 87 of transducer 86 and arm 84 of T-connector 82. The electrical output generated by differential transducer 86 is communicated to signal processing and recording apparatus (not shown) via conductor 96. Transducer 86 may be any of the conventionally known differential transducers presently used for measuring pressures in mud pulses. One transducer found to be particularly suited for the present invention is transducer model no. 1151 HP manufactured by Rosemount Inc. of Eden Prairie, Minn.

It is preferred that waveguide 90 comprise a flexible hose 94, although it may also be constructed of rigid conduit or tubing, for example. Hose 94 may be identical to hose 42 previously described with respect to FIG. 2. Importantly, hose 94 must have a sufficient length for it to function as a waveguide and cause at least a doubling of the pressure signal amplitude at pressure port 88 of transducer 86.

Conduit 89 is shorter than waveguide 90 so as to create a different pressure for sensing by differential pressure transducer 86. Conduit 89 may be very short relative to the length of hose 42 and need not function as a waveguide. Conduit 89 may comprise a flexible hose or may be constructed from rigid conduit or tubing.

T-connector 82, waveguide 90 and conduit 89 are filled with drilling fluid or another fluid so as to supply good acoustic paths for the pressure pulses 26. In an experiment where both waveguide 90 and conduit 89 were made of hydraulic hose having an internal diameter of one-quarter inch and were filled with the same drilling mud as was circulated in stand pipe 22, pressure transducer 86 measured a differential pressure amplitude that was double that incident at pressure port 30 where hose 90 was approximately 100 feet long and conduit 89 was approximately 3 feet long.

To provide for a better signal-to-noise ratio at detector 106, waveguide 90 may be filled with a fluid having a higher viscosity than the viscosity of the drilling mud 28 so as to more quickly damp out the higher frequency noise, such as that generated by mud pumps 18. In such an instance, waveguide 90 would include an internal membrane 48, such as that described with respect to FIG. 4, adjacent to T-connector 82 to prevent the noise-dampening fluid from becoming mixed with drilling mud 28. Alternatively, or additionally, detector 106 may be modified so as to create an even larger pressure differential at transducer 86 by substituting for waveguide 90, the waveguide 70 described with respect to FIG. 5. A waveguide 70 having a segment with a reduced inside diameter in relation to the rest of the waveguide may yield a quadrupling or more in the amplitude of the pressure signal detected by differential pressure transducer 86.

While the preferred embodiments of the invention have been shown and describe, modifications thereof can be made by one skilled in the an without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. An apparatus for detecting pressure pulses communicated through drilling fluid contained in a conduit comprising:

an access port formed in the conduit;

a pressure transducer for determining the pressure at an input port to said transducer and converting said pressure to an electrical signal.;

a waveguide disposed between said access port in the conduit and said input port in said transducer;

drilling fluid within said waveguide for transmitting the pressure pulses to said transducer; and a second fluid within said waveguide for transmitting the pressure pulses to said transducer, said second fluid having a viscosity greater than the viscosity of the drilling fluid.

2. The apparatus of claim 1 further comprising a membrane disposed in said waveguide for retaining said second fluid in said waveguide for retaining said second fluid in said waveguide and preventing the drilling fluid from becoming mixed with said second fluid.

3. An apparatus for detecting pressure pulses communicated through drilling fluid contained in a conduit comprising:

an access port formed in the conduit;

a pressure transducer for determining the pressure at an input port to said transducer and converting said pressure to an electrical signal; and a waveguide disposed between said access port in the conduit and said input port in said transducer, the waveguide including a first segment having a first inside diameter and a second segment having a second inside diameter which is less than said first inside diameter; and a second fluid contained within said waveguide for transmitting the pressure pulses to said transducer, said second fluid having a viscosity greater than the viscosity of the drilling fluid.

4. An apparatus for detecting an acoustic signal of wavelength W and frequency F in drilling mud contained in a conduit comprising:

a pressure port formed in the conduit;

a pressure transducer;

a hose having a first end connected to said pressure port and having a second end connected to said pressure transducer, wherein said hose has a length sufficient for said hose to function as a waveguide for the acoustic signal; and a fluid substantially filling said hose and having a viscosity greater than the viscosity of the drilling mud.

5. The apparatus of claim 4 further comprising means for retaining said fluid in said hose and maintaining a separation between said fluid and the drilling mud.

6. An apparatus for detecting an acoustic signal of wavelength W and frequency F in drilling mud contained in a conduit comprising:

a pressure port formed in the conduit;

a pressure transducer;

a hose having a first end connected to said pressure port and having a second end connected to said pressure transducer, wherein said hose has a length sufficient for said hose to function as a waveguide for the acoustic signal; and glycerine substantially filling said hose and having a viscosity greater than the viscosity of the drilling mud.

7. An apparatus for detecting an acoustic signal of wavelength W and frequency F in drilling fluid comprising:

a pipe containing the drilling fluid;

an access port in said pipe;

a T-connector connected to said access port, said T-connector including a first and second output end;

a differential pressure transducer having a first and second input port;

a waveguide comprising a hose and being connected between said first output end of said T-connector and said first input port of said pressure transducer;

a conduit connected between said second output end of said T-connector and said second input port of said pressure transducer; and a second fluid contained within said waveguide and having a viscosity greater than the viscosity of the drilling fluid.

8. The apparatus of claim 7 further comprising a diaphragm disposed in said waveguide, said diaphragm separating said second fluid and the drilling fluid.

9. The apparatus of claim 8 wherein said waveguide comprises a first segment having a first inside diameter and a second segment having a second inside diameter, wherein said second inside diameter is less than said first inside diameter.

10. The apparatus of claim 9 wherein said second segment comprises a hose.

11. The apparatus of claim 10 wherein said second has a length of at least ¼W.

12. The apparatus of claim 11 wherein said second segment contains a second fluid having a viscosity greater than the viscosity of the drilling fluid.

13. A method for detecting an acoustic signal of wavelength W and frequency F in drilling fluid flowing in a supply line comprising the steps of:

providing an access port in the supply line;

providing a pressure transducer for sensing the acoustic signal and converting the acoustic signal into electrical signals;

connecting a waveguide between said pressure transducer and said access port; and substantially filling said waveguide with a fluid having a viscosity greater than the viscosity of the drilling fluid and capable of conducting acoustic signals.

14. The method of claim 13 further comprising a membrane in said waveguide for maintaining separation between said fluid and said drilling fluid.

* * * * *